United States Patent [19]

Hankin

[11] 3,942,458

[45] Mar. 9, 1976

[54] ELEVATING PILOTHOUSE

[75] Inventor: Donald Cameron Hankin, Freehold, N.J.

[73] Assignee: McAllister Brothers Inc., New York, N.Y.

[22] Filed: Dec. 19, 1974

[21] Appl. No.: 534,225

[52] U.S. Cl. ..... 114/71; 187/17

[51] Int. Cl.[2] ..... B63B 29/02; B66B 11/00

[58] Field of Search ..... 114/16 B, .5 R, 71, 235 R, 114/65 R; 187/17, 8.43

[56] References Cited

UNITED STATES PATENTS

| | | | |
|---|---|---|---|
| 513,524 | 1/1894 | McDougall | 114/71 |
| 1,296,689 | 3/1919 | Noah | 114/16 B |
| 1,915,024 | 6/1933 | Logette et al. | 187/8.43 |

*Primary Examiner*—Trygve M. Blix
*Assistant Examiner*—Sherman D. Basinger
*Attorney, Agent, or Firm*—Brumbaugh, Graves, Donohue & Raymond

[57] ABSTRACT

A water-faring vessel having a plurality of decks and a pilothouse movably mounted atop a deck and capable of being elevated above the deck and lowered onto the deck comprises a passageway which permits interior human passage between the pilothouse and at least one deck when the pilothouse is in an unelevated position atop the deck. The passageway also permits interior human passage between the pilothouse and at least one deck when the pilothouse is in an elevated position above the deck.

8 Claims, 7 Drawing Figures

10
12
14
16
18
20
22
24
26
28
30
32
34
36
38
42
58
60
80
82
92

ELEVATING PILOTHOUSE

The present invention relates to elevating pilothouses for water-faring vessels, and, more particularly, to a novel and improved, completely enclosed, weatherproof passageway for the pilothouse when it is an elevated position.

In general, water-faring vessels are controlled from a pilothouse located near the top of the vessel. When visibility from the pilothouse is impaired, the probability of waterway accidents is augmented, thereby creating a substantial safety hazard.

In practice, water-faring vessels, especially tugboats and the like, encounter many situations in which the visibility from the pilothouse is impaired by sources other than the elements. For example, a single tugboat will usually be dispatched to transport a barge from one location to another. When the barge is loaded, it has a relatively large draft. Since the large draft causes the barge to ride very low in the water, the visibility from the pilothouse is essentially unimpaired by the barge. However, when the barge is unloaded, the draft is decreased and the barge rides higher in the water. Thus the visibility from the pilothouse may be disadvantageously impaired by an unloaded barge.

To eliminate this disadvantage, tugboats have heretofore been provided with a permanently elevated main or auxiliary pilothouse. Such elevated pilothouses are fixedly mounted upon a rigid structural framework in an elevated position above the uppermost deck of the vessel.

Although the permanently elevated pilothouses improve the visibility from the pilothouse, the overall utility and efficiency of the vessel is diminished in other respects. Firstly, if both a regular pilothouse and a permanently elevated auxiliary pilothouse are employed, each pilothouse must be provided with a complete set of controls. The construction of a vessel having two fully equipped pilothouses disadvantageously increases construction time and cost.

This disadvantage may be eliminated by dispensing with the regular pilothouse and allowing the permanently elevated pilothouse to serve as the regular pilothouse. However, this is impractical if the vessel is to be used in heavy seas, since a helmsman attempting to navigate the vessel in heavy seas from the elevated pilothouse would probably be affected by motion sickness due to the exaggerated rolling and pitching of his lofty position.

A second major disadvantage of permanently elevated pilothouses is the obstruction they create. One important problem is passing under fixed span bridges, particularly on barge canals used for petroleum distribution. Because tugboats may also be used to dock ships, a second typical problem is that the permanently elevated pilothouse is often damaged by colliding against the flair of a ship's bow or stern during the docking operation.

Because of the various problems attendant with permanently elevated pilothouses, certain vessels have been designed with elevating pilothouses. In this type of construction, the vessel has a single pilothouse which may be elevated and lowered as conditions warrant. Elevating pilothouses have heretofore been employed on canal towboats having relatively low profiles and on tugboats having higher profiles. On canal towboats, the pilothouse is elevated to increase visibility and lowered to pass under bridges. On tugboats, the pilothouse is elevated to increase visibility when the tugboat is towing high riding barges, as explained hereinabove, and lowered when conditions warrant.

In both instances, however, an interior passageway for crewmen is only provided, if at all, when the pilothouse is in an unelevated position. Thus when the pilothouse is elevated, human access to the pilothouse has been provided in the past by a telescoping or pivoting exterior ladder. Furthermore, since no interior passageway is provided when the pilothouse is in an elevated position, all control and power cables must communicate with the pilothouse exteriorly, thereby being exposed to the elements.

Exterior human access to the pilothouse creates a real safety hazard, since rough water or bad weather make travel up and down the exterior ladder extremely treacherous. Even in fair weather or light seas the rolling motion of the vessel and the presence of moisture on the exterior ladder create a potentially dangerous condition.

Similarly, exposure of the control and power cables to the elements creates a safety hazard by increasing the likelihood of control and power cable failure. Failure of the control and power cables could result in the tugboat being rendered powerless and uncontrollable, thereby increasing the likelihood of a waterway mishap.

In an elevated position, the pilothouse has a tendency to vibrate, particularly when the engine of the vessel is running at maximum power. This vibration can cause damage to the delicate electronic equipment in the pilothouse. Thus elimination of vibration is important, especially since failure of the electronic equipment could create a dangerous navigational hazard in bad weather and again increase the likelihood of a waterway mishap.

In accordance with the invention, there is provided a novel and improved hydraulic installation for a water-faring vessel having a plurality of decks and a pilothouse movably mounted atop a deck. The hydraulic installation, which normally includes a source of hydraulic fluid and a fluid pressure responsive hydraulic jack capable of elevating the pilothouse above the deck and lowering the pilothouse onto the deck, also includes a shaftway extending vertically through the decks beneath the pilothouse. A plunger of the hydraulic jack is fixedly mounted in a vertical position in the shaftway; while a cylinder of the hydraulic jack is attached to the pilothouse and slidably mounted about the plunger for vertical reciprocating movement thereon.

The shaftway is designed with rigid structural members and a system of roller guides. The rigid structural members and the system of roller guides, in conjunction with the relatively large horizontal cross section of the shaftway, provide strength and stability for minimizing vibration in the pilothouse when it is in an elevated position.

The invention further includes a stairwell mounted beneath the pilothouse for vertical reciprocating movement in the shaftway with the cylinder. A stairway completely enclosed within the stairwell is provided for permitting interior human passage between the pilothouse and at least one deck when the pilothouse is elevated above the deck and for permitting interior human passage between the pilothouse and at least one deck when the pilothouse is lowered onto the deck. Since the stairway is completely enclosed by the stairwell, a safe and weatherproof passageway to and from the pilothouse is provided.

When the pilothouse is mounted atop an uppermost deck the stairwell may include a plurality of doors, the number of which is dependent upon the number of decks on the vessel. In a preferred embodiment, the stairwell includes a first door which provides access to a lowermost deck when the pilothouse is lowered onto the uppermost deck and which provides access to a deck directly below the uppermost deck when the pilothouse is elevated above the uppermost deck to a first predetermined elevation. A second door located in the stairwell above the first door provides access to the deck directly below the uppermost deck when the pilothouse is elevated above the uppermost deck to a second predetermined elevation which is lower than the first predetermined elevation. A third door is also located in the stairwell above the second door for providing access to the deck directly below the uppermost deck when the pilothouse is lowered onto the uppermost deck. Thus the present invention allows the pilothouse to be elevated to variable heights. More particularly, when the heights to which the pilothouse is elevated correspond to the distance between the decks, an interior human passageway is provided between the pilothouse and at least one deck.

The stairway may be of the spiral type with a landing adjacent each of the doors. By employing a stairwell having a square cross section and a spiral stairway, the corners of the stairwell may be employed as an interior conduit for housing the control and power cables which communicate with the pilothouse.

To insure maximum safety, an electrical interlock system may be utilized for preventing the opening of any door which is elevated above the uppermost deck. Also, a safety mechanism may be used to prevent the raising and lowering of the pilothouse if any door is open.

For a more complete understanding of the invention reference may be had to the following detailed description taken in conjunction with the accompanying figures of the drawing, in which.

Figures 1, 3A:
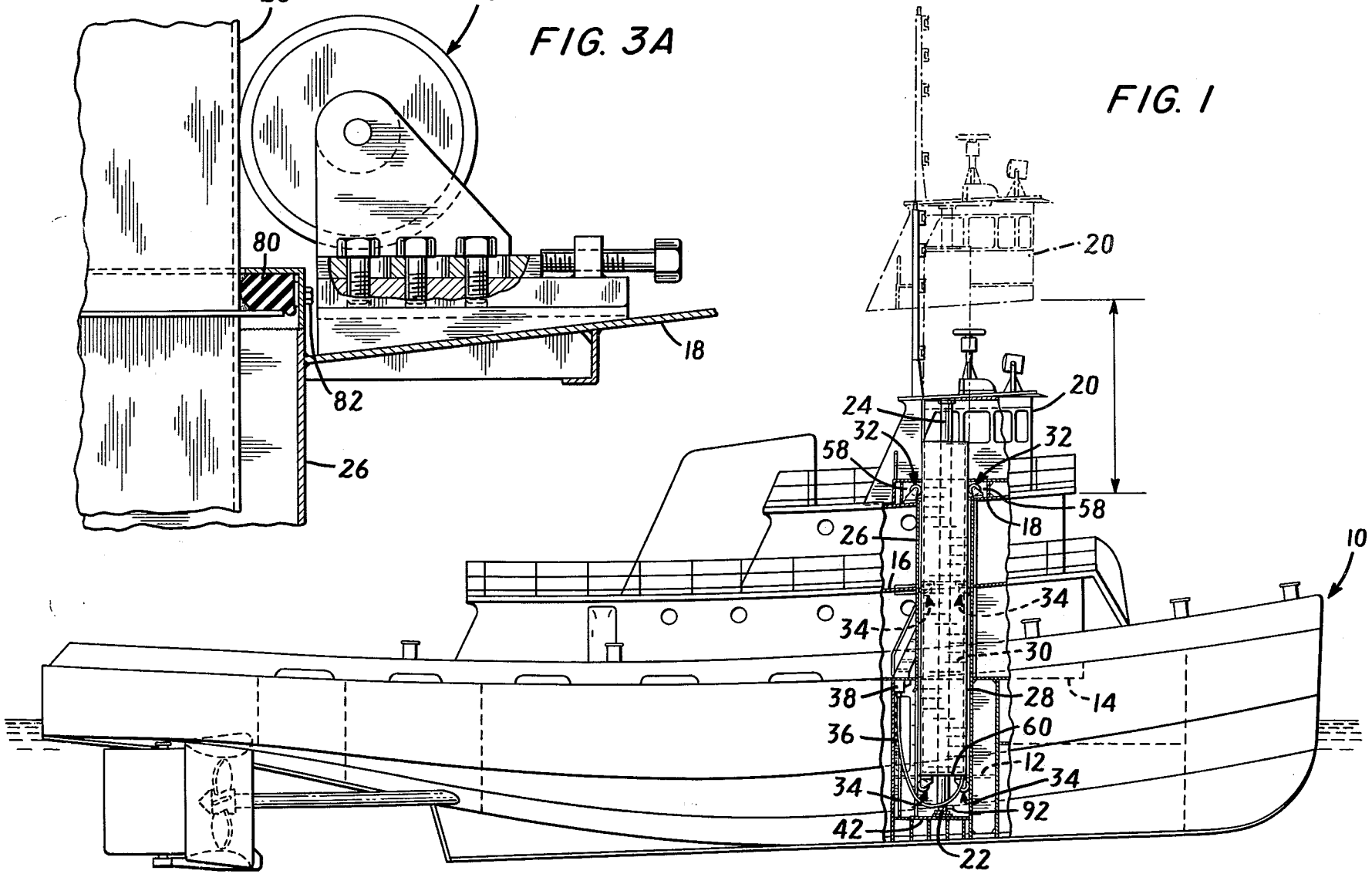
FIG. 1 is a side elevational view, partially cut away, of the hydraulic installation of the present invention positioned in a tugboat.
Figure 2:
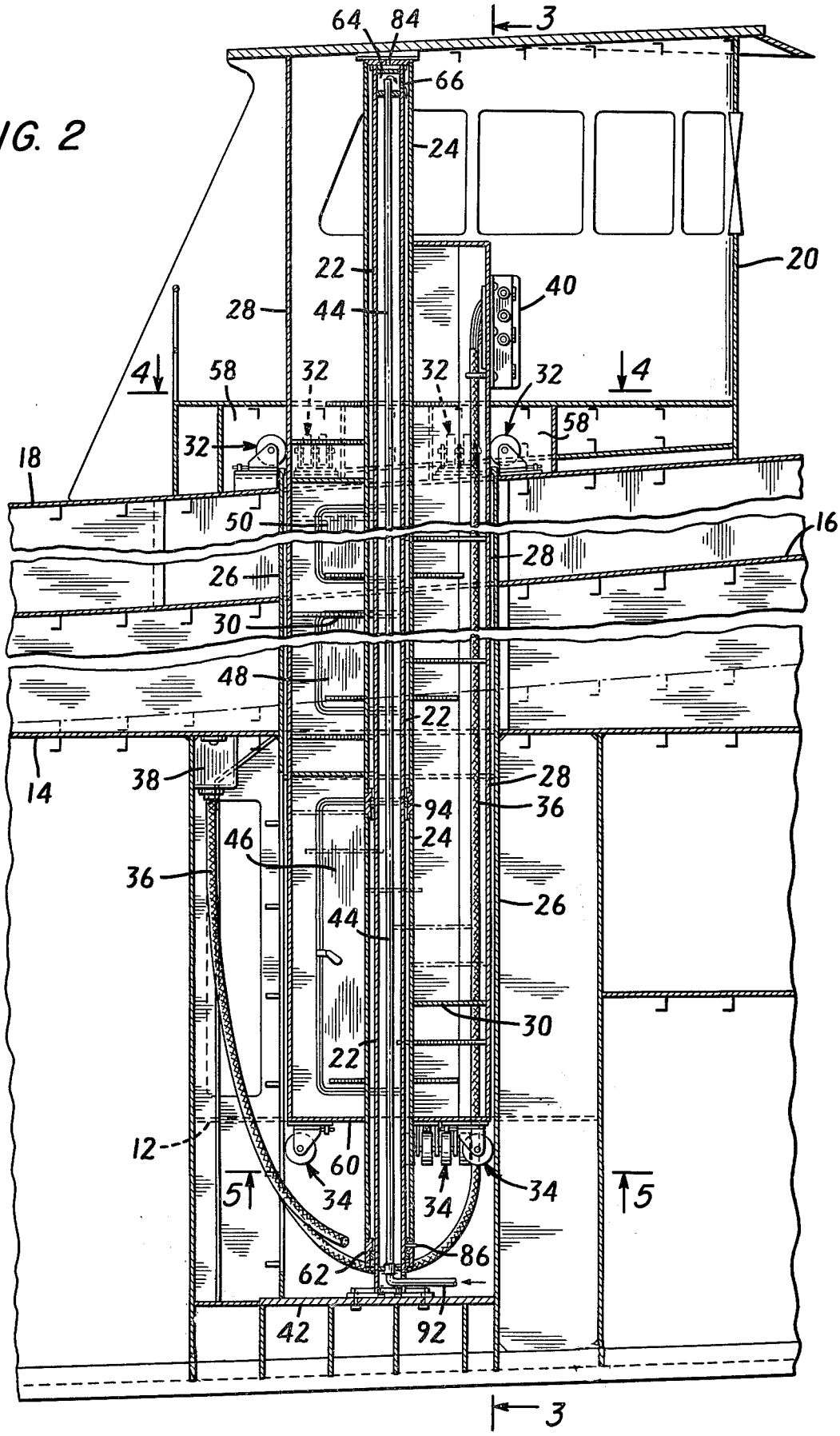
FIG. 2 is a detailed cross sectional view of the hydraulic installation shown in FIG. 1.
Figure 3:
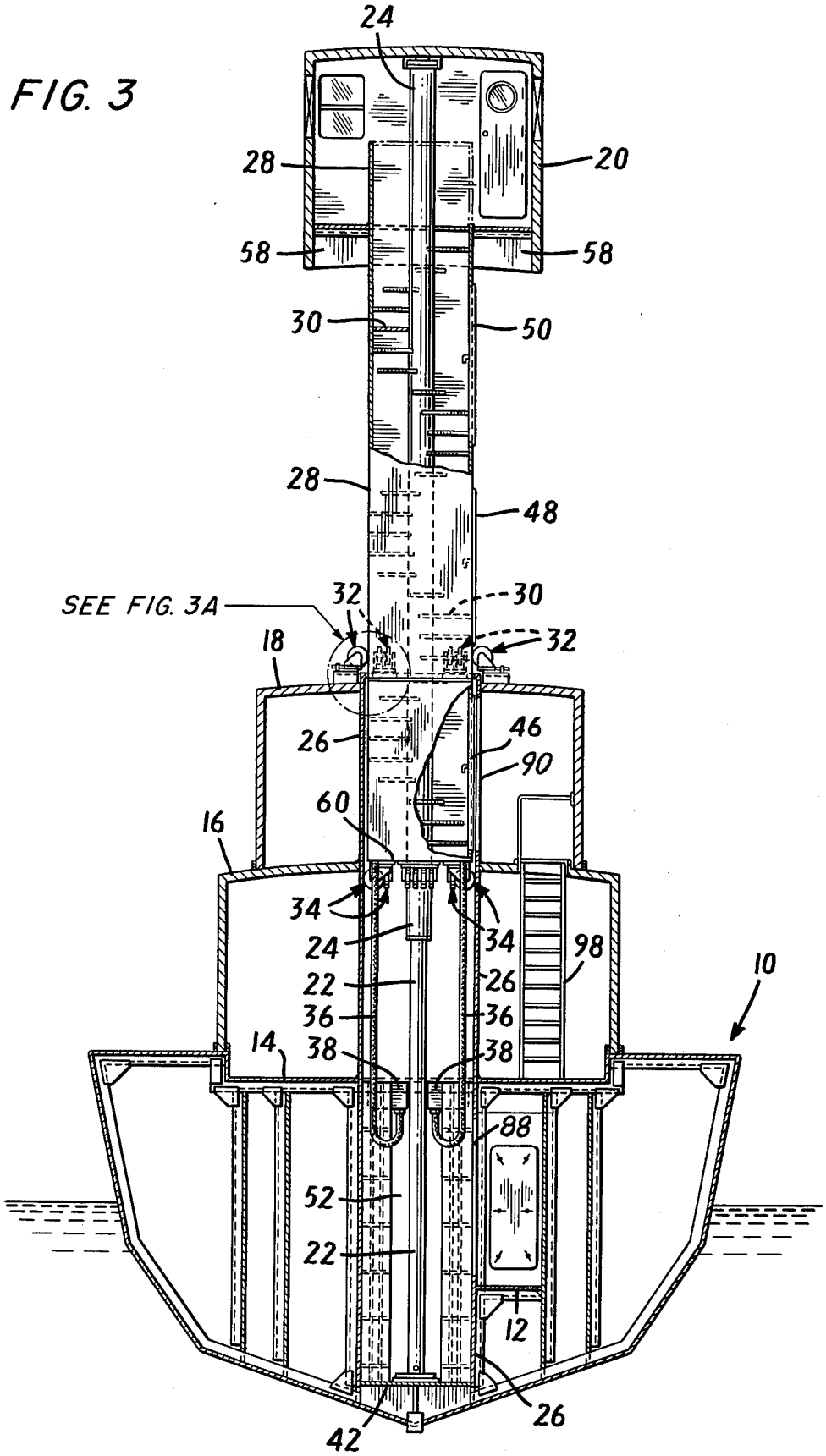
FIG. 3 is a cross sectional view, taken along the lines 3—3 in FIG. 2 and looking in the direction of the arrows, of the hydraulic installation of FIG. 2.
Figure 4:
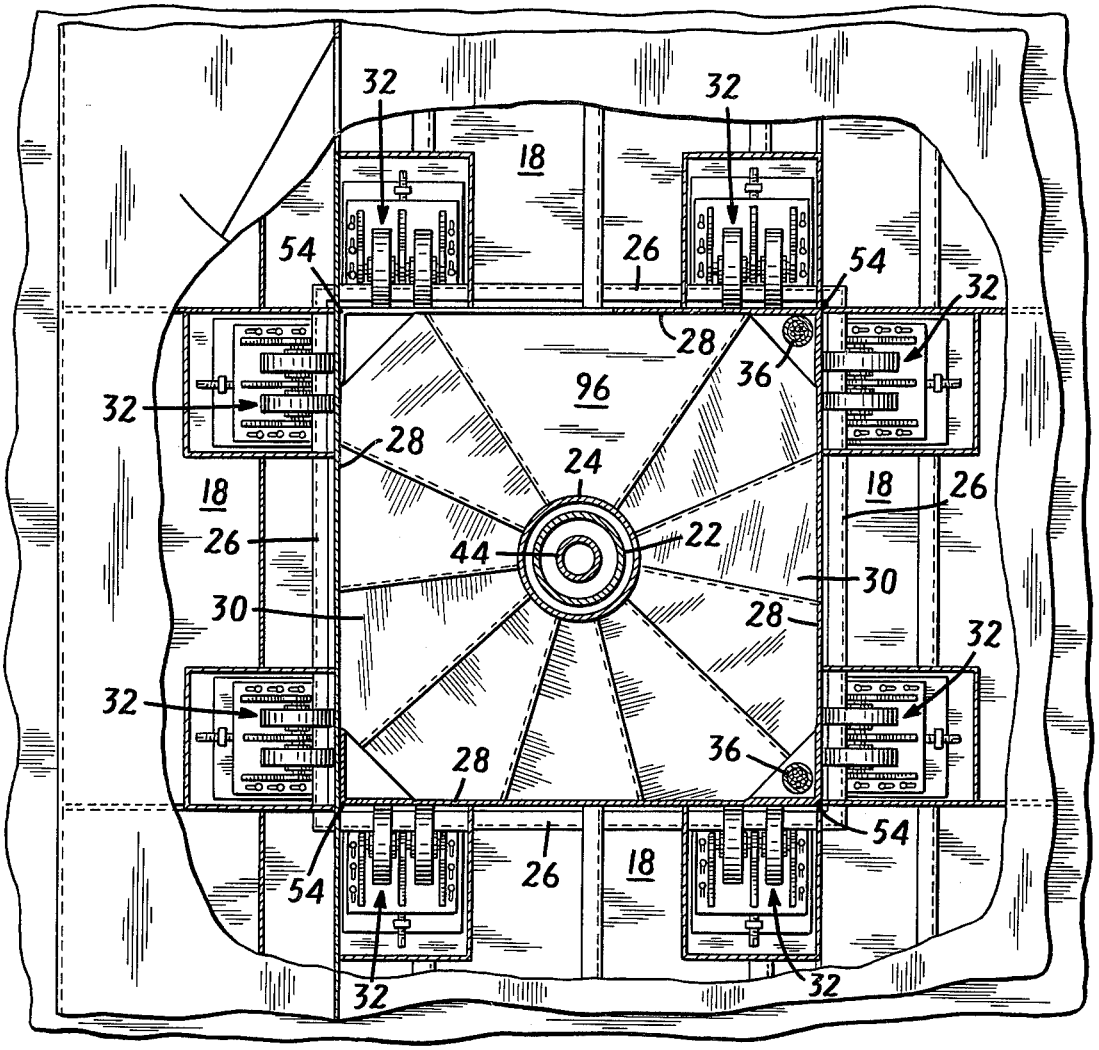
Figure 5:
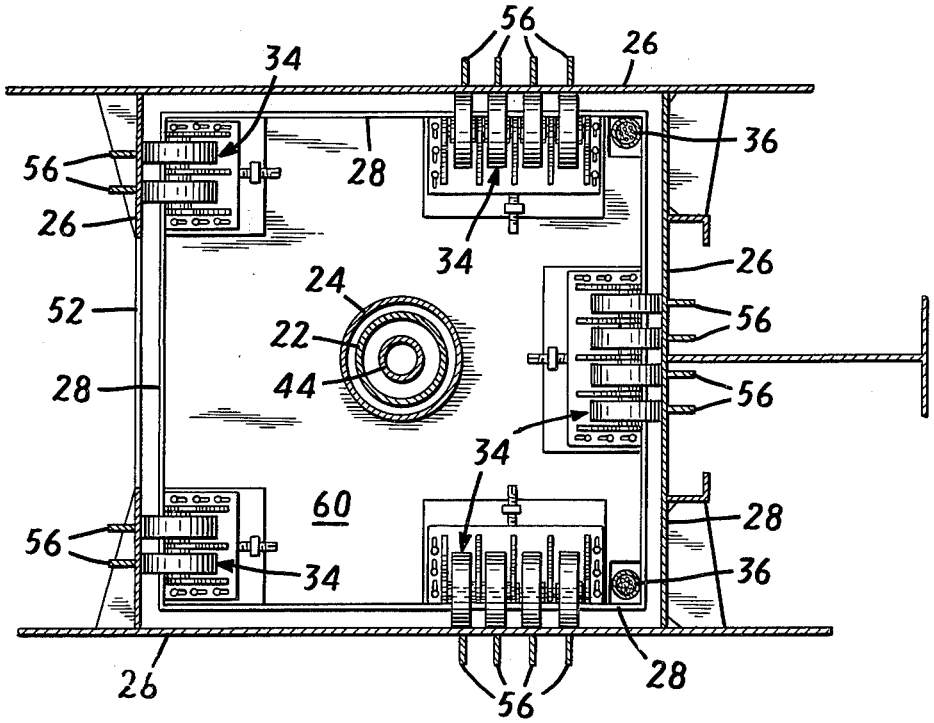
Figure 6:
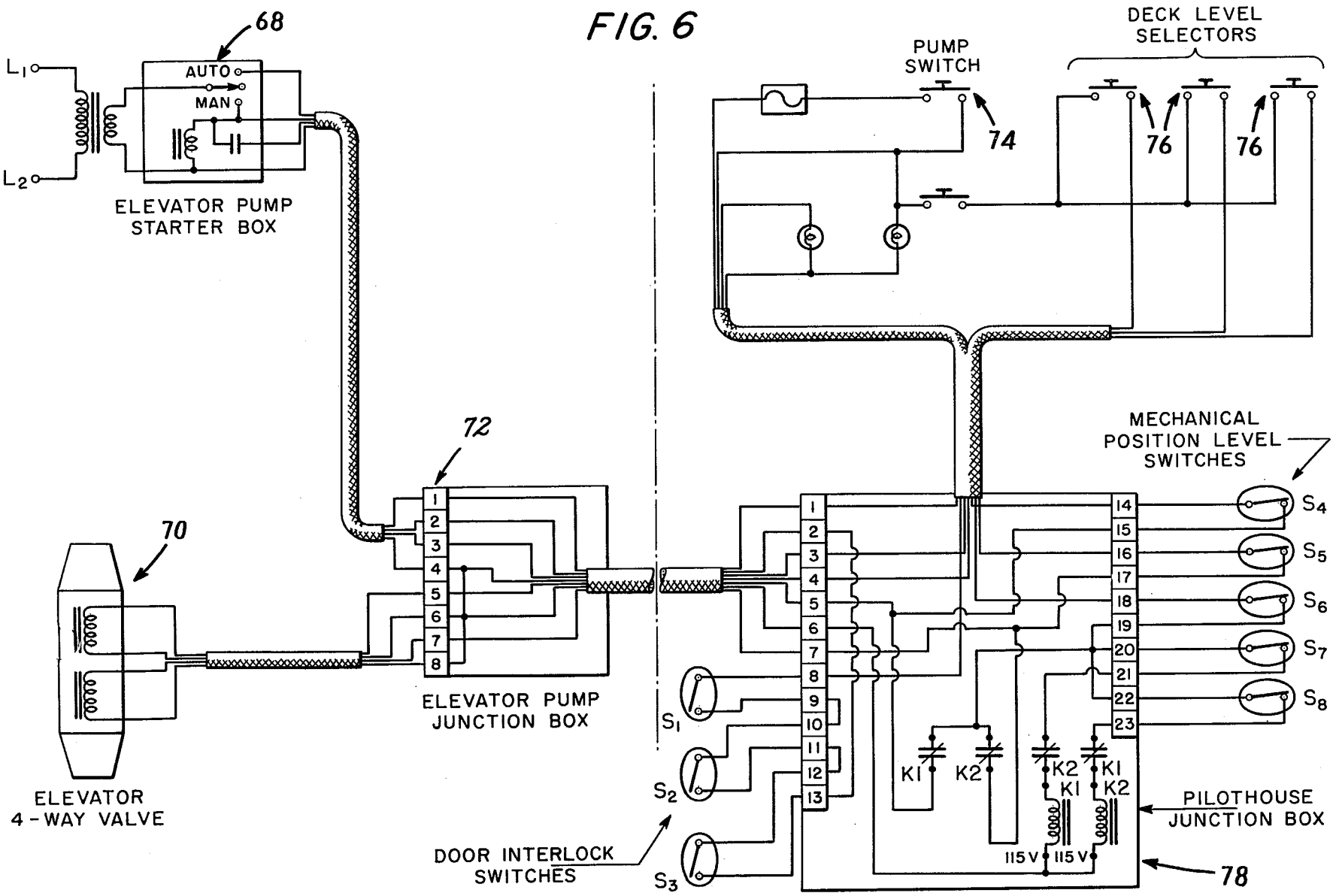

FIG. 3*a* is a detailed side elevational view of the rollers and sealing mechanism shown in FIG. 3;

FIG. 4 is a cross sectional view, taken along the lines 4—4 in FIG. 2 and looking in the direction of the arrows, of the hydraulic installation of FIG. 2;

FIG. 5 is a cross sectional view, taken along lines 5—5 of FIG. 2 and looking in the direction of the arrows, of the hydraulic installation of FIG. 2; and FIG. 6 is a schematic of the electrical circuitry for operating the hydraulic installation of the present invention.

In FIGS. 1 and 3, there is shown a tugboat 10 having a lowermost deck 12 a main deck 14, an intermediate deck 16 an uppermost deck 18, and a pilothouse 20 atop the uppermost deck 18. The tugboat 10 includes an hydraulic installation for elevating the pilothouse 20 above the uppermost deck 18, as indicated by the phantom lines in FIG. 1, and for lowering the pilothouse 20 onto the uppermost deck 18.

The hydraulic installation includes a shaftway 26 extending vertically through the decks 12, 14, 16 and 18 beneath the pilothouse 20. A hollow plunger 22 of the hydraulic jack is fixedly mounted in a vertical position on a horizontal support plate 42 in the shaftway 26. A cylinder 24 of the hydraulic jack is attached to the roof of the pilothouse 20 and slidably mounted about the plunger 22 for vertical reciprocating movement thereon.

In FIG. 2, the plunger 22 houses a vertical fluid conduit or pipe 44. The pipe 44 has an inlet located at a lowermost end of the plunger 22 and an outlet located in a chamber 64 located at an uppermost end of the plunger 22. The inlet of pipe 44 is connected to a source of hydraulic fluid (not shown) by a horizontal pipe or conduit 92; while the outlet of the vertical pipe 44 communicates with the chamber 64 in the uppermost end of the plunger 22. An aperture 66 in a sidewall of the chamber 64 communicates with the cylinder 24. Thus the pipe 44 in the plunger 22 forms a fluid conduit between the source of hydraulic fluid and the cylinder 24. When hydraulic fluid is introduced into the cylinder 24, the pilothouse 20 carried thereby may be vertically elevated above the uppermost deck 18 to a height determined by the length of the plunger 22 and the cylinder 24.

The cylinder 24 includes a pair of bearing and seal combinations 62, 94; and a pair of air bleeds 84, 86 (see FIG. 2). The bearing and seal combination 62 located at a lowermost end of the cylinder 24 and the bearing and seal combination 94 located between the lowermost end and an uppermost end of the cylinder 24 provide a fluid tight seal for the cylinder 24. The air bleed 86 located at the lowermost end of the cylinder 24 and the air bleed 84 located at the uppermost end of the cylinder 24 permit the release of entrapped air from the cylinder 24.

A stairwell 28 is mounted beneath the pilothouse 20 for vertical reciprocating movement in the shaftway 26 with the cylinder 24. In the embodiment of FIGS. 1–5, the stairwell 28 is disposed coaxially about the cylinder 24. A lowermost end 60 of the stairwell 28 is fixedly attached to the cylinder 24; while an uppermost end of the stairwell 28 communicates with the pilothouse 20.

A spiral stairway 30 is located within the stairwell 28 for permitting interior human passage between the pilothouse 20 and at least one of the decks 12, 14 and 16 when the pilothouse 20 is elevated above the uppermost deck 18 and for permitting interior human passage between the pilothouse 20 and at least one of the decks 12, 14 and 16 when the pilothouse 20 is lowered onto the uppermost deck 18. Since the stairway 30 is completely enclosed by the stairwell 28, a safe and weatherproof passageway to and from the pilothouse 20 is provided.

When the pilothouse 20 is mounted atop the uppermost deck 18, the stairwell 28 may include a plurality of doors, the number of which will depend upon the number of decks on the tugboat 10. As shown in FIG. 3, the stairwell 28 includes a first door 46 which provides access to the lowermost deck 12 through an access opening 88 when the pilothouse 20 is lowered onto the uppermost deck 18. When the pilothouse 20 is elevated above the uppermost deck 18 to a first predetermined elevation corresponding to the distance between the lowermost deck 12 and the intermediate deck 16, the first door 46 provides access to the intermediate deck 16, which is directly below the uppermost deck 18, through an access opening 90. A second door 48 located in the stairwell 28 above the first door 46 provides access to the intermediate deck 16 through the access opening 90 when the pilothouse 20 is elevated above the uppermost deck 18 to a second predetermined elevation corresponding to the distance between the lowermost deck 12 and the main deck 14. A third door 50 is also located in the stairwell 28 above the second door 48 for providing access to the intermediate deck 16 through the access opening 90 when the pilothouse 20 is lowered onto the uppermost deck 18. The spiral stairway 30 includes landings 96 (see FIG. 4) adjacent each of the doors 46, 48 and 50.

Although access to the main deck is not directly provided in the embodiment of FIGS. 1–3, a conventional interior ladder 98 (see FIG. 3) provides access to the main deck 14 from the intermediate deck 16. If desired, an access opening may be located in the shaftway 26 at the main deck level for providing direct access to the main deck 16 from the stairwell 28.

In the embodiment of FIGS. 1–5, the spiral stairway 30 is enclosed within the stairwell 28 which has a square cross section. This design allows the corners of the stairwell 28 to be utilized as an interior conduit for housing control and power cables 36 which run from a terminal box 38 mounted below the main deck 14 to a control panel 40 mounted in the pilothouse 20 (see FIGS. 4 and 5). A slot 52 (see FIG. 3) in the lower portion of the shaftway 26 permits the control and power cables 36 to communicate with the stairwell 28. The control and power cables 36 are of sufficient length to communicate with the pilothouse 20 when it is in an elevated position (see FIG. 3). When the pilothouse is lowered onto the uppermost deck 18, the control and power cables 36 loop downward below the stairwell 28.

In FIGS. 3*a*, 4 and 5, there is shown a system of rollers which facilitate the vertical reciprocating movement of the stairwell 28 in the shaftway 26. As shown in FIG. 4, eight sets of rollers 32 are mounted atop the uppermost deck 18 externally of the stairwell 28. The rollers 32 also function to stabilize and center the stairwell 28 when the pilothouse 20 is in an elevated position above the uppermost deck 18. When the pilothouse 20 is lowered onto the uppermost deck 18, the rollers 32 are contained within housings 58 located in the bottom of the pilothouse 20 (see FIGS. 1–3). To provide a sufficiently strong bearing surface for the rollers 32, the corner plates 54 (see FIG. 4) of the stairwell 28 are made of a thicker gage metal than the rest of the stairwell 28.

To further facilitate the vertical reciprocating movement of the stairwell 28 in the shaftway 26, five sets of rollers 34 are mounted from the bottom 60 of the stairwell 28. The rollers 34 engage the interior walls of the shaftway 26 during the raising and lowering of the pilothouse 20. Vertical reinforcing bars 56 (see FIG. 5) are fixedly attached to the outside walls of the shaftway 26 in substantial alignment with the rollers 34 to provide a sufficiently strong bearing surface for the rollers 34.

To prevent water and other moisture from entering the shaftway 26, a sealing member 80 of any suitable conventional form lines the uppermost end of the shaftway 26 (see FIG. 3*a*). Preferably, the sealing member 80 is rubberized weather stripping fixedly attached just below the upper lip of the shaftway 26 by bolts 82. The sealing member 80 remains in contact with the outer surface of the stairwell 28 during the raising and lowering of the pilothouse 20.

In FIG. 6, there is shown a schematic diagram of the electrical components of the hydraulic installation shown in FIGS. 1–5. The electrical components include an elevator pump starter box 68, an elevator 4-way valve 70 for alternatively connecting the pump or reservoir to the plunger 22 and the cylinder 24, and an elevator pump junction box 72. A pump switch 74 and deck level selectors 76 of the deadman fail-safe variety are located in the pilothouse. Also located in the pilothouse are a pilothouse junction box 78; mechanical position level switches $S_4$, $S_5$, $S_6$, $S_7$ and $S_8$; and door interlock switches $S_1$, $S_2$ and $S_3$.

The door interlock switches $S_1$, $S_2$ and $S_3$ are utilized to prevent the opening of the doors 46, 48 and 50 when they are elevated above the uppermost deck 18. Also, a safety mechanism may be used to prevent the raising and lowering of the pilothouse 20 if any of the doors 46, 48 and 50 is open. As a further safety measure, a manually operated emergency let down system may be provided to permit the lowering of the pilothouse 20 upon failure of the electrical components controlling the hydraulic jack.

Thus there is provided, in accordance with the invention, a novel and improved passageway for an elevating pilothouse which permits interior human passage between the pilothouse and at least one deck when the pilothouse is in an elevated and an unelevated position.

It will be understood by those skilled in the art that the above described embodiment is meant to be merely exemplary in that it is susceptible of modification and variation without departing from the spirit and scope of the invention. For example, the number of decks may be varied and the pilothouse may be mounted atop decks other than the uppermost deck. Also, the number of decks to which access is provided from the passageway may be varied to suit the needs of the vessel. Therefore, the invention is not deemed to be limited except as defined in the appended claims.

I claim:

1. An hydraulic installation of a water-faring vessel having a plurality of decks and a pilothouse movably mounted atop a deck, the pilothouse having a control panel for receiving control and power cables from a lower deck, comprising a shaftway extending vertically through the decks beneath the pilothouse; a hydraulic jack for elevating the pilothouse above the deck and lowering the pilothouse onto the deck, said hydraulic jack including a plunger fixedly mounted in a vertical position in said shaftway and a cylinder attached to the pilothouse and slidably mounted about said plunger for vertical reciprocating movement thereon; a stairwell mounted beneath the pilothouse for vertical reciprocating movement in said shaftway with said cylinder, said stairwell including means for housing the control and power cables within said stairwell, whereby a weatherproof passageway to and from the pilothouse is provided for the control and power cables; and stairway means located within said stairwell for permitting interior human passage between the pilothouse and at least one deck when the pilothouse is elevated above the deck and for permitting interior human passage between the pilothouse and at least one deck when the pilothouse is lowered onto the deck, whereby a safe, weatherproof passageway to and from the pilothouse is provided.

2. An hydraulic installation for a water-faring vessel having a plurality of decks and a pilothouse movably mounted atop an uppermost deck, comprising a shaftway extending vertically through the decks beneath the pilothouse; an hydraulic jack for elevating the pilothouse above the uppermost deck and lowering the pilothouse onto the uppermost deck, said hydraulic jack including a plunger fixedly mounted in a vertical position in said shaftway and a cylinder attached to the pilothouse and slidably mounted about said plunger for vertical reciprocating movement thereon; a stairwell mounted beneath the pilothouse for vertical reciprocating movement in said shaftway with said cylinder, said stairwell including a first door for providing access to the lowermost deck when the pilothouse is lowered onto the uppermost deck and for providing access to the deck directly below the uppermost deck when the pilothouse is elevated above the uppermost deck to a first predetermined elevation, a second door located above said first door for providing access to the deck directly below the uppermost deck when the pilothouse is elevated above the uppermost deck to a second predetermined elevation, said second predetermined elevation being lower than said first predetermined elevation, and a third door located above said second door for providing access to the deck directly below the uppermost deck when the pilothouse is lowered onto the uppermost deck; interlock means for preventing the opening of said second door when said second door is elevated above the uppermost deck and for preventing the opening of said third door when said third door is elevated above the uppermost deck; safety means for preventing the raising and lowering of the pilothouse if any of said first, second and third doors is open; and stairway means located within said stairwell for permitting interior human passage between the pilothouse and at least one deck when the pilothouse is elevated above the uppermost deck to said first and second predetermined elevations and for permitting interior human passage between the pilothouse and at least one deck when the pilothouse is lowered onto the uppermost deck, whereby a safe, weatherproof passageway to and from the pilothouse is provided.

3. An hydraulic installation according to claim 2, wherein said stairway means is a spiral stairway having a landing adjacent said first, second and third doors.

4. An hydraulic installation according to claim 2, wherein said stairwell includes said cylinder and completely encloses said stairway means to provide a safe, weatherproof passageway to and from the pilothouse.

5. An hydraulic installation for a tugboat having a plurality of decks and a pilothouse movably mounted atop an uppermost deck, comprising a shaftway extending vertically through the decks beneath the pilothouse; a source of hydraulic fluid; a fluid pressure responsive hydraulic jack for elevating the pilothouse above the uppermost deck and lowering the pilothouse onto the uppermost deck, said hydraulic jack including a plunger fixedly mounted in a vertical position in said shaftway and a cylinder attached to the pilothouse and slidably mounted about said plunger for vertical reciprocating movement thereon, said plunger having an inlet located at the lowermost end of said plunger for receiving hydraulic fluid from said source of hydraulic fluid and an outlet located at the uppermost end of said plunger and communicating with said cylinder and said inlet for supplying hydraulic fluid to said cylinder, whereby said cylinder reciprocates vertically on said plunger under the influence of fluid pressure conditions within said cylinder; a stairwell mounted beneath the pilothouse for vertical reciprocating movement in said shaftway with said cylinder, said stairwell including a first door for providing access to the lowermost deck when the pilothouse is lowered onto the uppermost deck and for providing access to the deck directly below the uppermost deck when the pilothouse is elevated above the uppermost deck to a first predetermined elevation, a second door located above said first door for providing access to the deck directly below the uppermost deck when the pilothouse is elevated above the uppermost deck to a second predetermined elevation, said second predetermined elevation being lower than said first predetermined elevation, and a third door located above said second door for providing access to the deck directly below the uppermost deck when the pilothouse is lowered onto the uppermost deck; a spiral stairway completely enclosed within said stairwell and having a landing adjacent said first, second and third doors, whereby an interior human passageway between the pilothouse and at least one deck is provided with the pilothouse is elevated above the uppermost deck to said first and second predetermined elevations and when the pilothouse is lowered onto the uppermost deck; interlock means for preventing the opening of said second door when said secoond door is elevated above the uppermost deck and for preventing the opening of said third door when said third door is elevated above the uppermost deck; and safety means for preventing the raising and lowering of the pilothouse when any of said first, second and third doors is open, whereby a safe, weatherproof passageway to and from the pilothouse is provided.

6. An hydraulic installation according to claim 5, wherein the pilothouse includes a control panel for receiving control and power cables from a lower deck; and wherein said stairwell surrounds said cylinder and includes means for housing said control and power cables, whereby a weatherproof passageway to and from the pilothouse is provided for said control and power cables.

7. An hydraulic installation according to claim 6, wherein said shaftway and said stairwell are square in cross section; and wherein said means for receiving said control and power cables is a conduit formed in the corners of said stairwell between said stairwell and said spiral stairway.

8. An hydraulic installation according to claim 7, further comprising first roller means mounted at the lowermost end of said stairwell and bearing against all inner walls of said shaftway and second roller means mounted at the uppermost end of said shaftway and bearing against all outer walls of said stairwell, whereby strength and stability for minimizing vibration in the pilothouse when the pilothouse is in an elevated position is provided.

* * * * *

UNITED STATES PATENT AND TRADEMARK OFFICE

CERTIFICATE OF CORRECTION

PATENT NO. : 3,942,458

DATED : March 9, 1976

INVENTOR(S) : DONALD CAMERON HANKIN

It is certified that error appears in the above-identified patent and that said Letters Patent are hereby corrected as shown below:

Col. 1, line 6, after "is" insert --in--;
Col. 6, line 44, "of" should read --for--;
Col. 6, line 49, "a" should read --an--; and
Col. 8, line 29, "with" should read --when--.

Signed and Sealed this

Twentieth Day of July 1976

[SEAL]

*Attest:*

RUTH C. MASON
*Attesting Officer*

C. MARSHALL DANN
*Commissioner of Patents and Trademarks*